US011127523B2

(12) United States Patent
Kim et al.

(10) Patent No.: US 11,127,523 B2
(45) Date of Patent: Sep. 21, 2021

(54) INDUCTOR

(71) Applicant: SAMSUNG ELECTRO-MECHANICS CO., LTD., Suwon-si (KR)

(72) Inventors: Mi Geum Kim, Suwon-si (KR); Byeong Cheol Moon, Suwon-si (KR); Joung Gul Ryu, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 321 days.

(21) Appl. No.: 16/178,437

(22) Filed: Nov. 1, 2018

(65) Prior Publication Data

US 2019/0371513 A1 Dec. 5, 2019

(30) Foreign Application Priority Data

Jun. 4, 2018 (KR) ..... 10-2018-0064147

(51) Int. Cl.

| | |
|---|---|
| ***H01F 5/00*** | (2006.01) |
| ***H01F 27/28*** | (2006.01) |
| ***H01F 27/29*** | (2006.01) |
| ***H01F 27/32*** | (2006.01) |
| ***H01F 17/00*** | (2006.01) |

(Continued)

(52) U.S. Cl.

CPC ..... *H01F 27/2804* (2013.01); *H01F 17/0013* (2013.01); *H01F 27/29* (2013.01); *H01F 27/327* (2013.01); *H01F 41/042* (2013.01); *H01F 41/125* (2013.01); *H01F 2027/2809* (2013.01)

(58) Field of Classification Search

CPC ..... H01F 27/292
USPC ..... 336/200
See application file for complete search history.

(56) References Cited

U.S. PATENT DOCUMENTS

| | | | |
|---|---|---|---|
| 9,945,042 | B2 | 4/2018 | Cha et al. |
| 2007/0045746 | A1 | 3/2007 | Sunohara |

(Continued)

FOREIGN PATENT DOCUMENTS

| | | | |
|---|---|---|---|
| CN | 103065764 | A | 4/2013 |
| CN | 104934187 | A | 9/2015 |

(Continued)

OTHER PUBLICATIONS

English translation of JP201389876 (Year: 2013).*

(Continued)

*Primary Examiner* — Ronald Hinson
(74) *Attorney, Agent, or Firm* — Morgan, Lewis & Bockius LLP

(57) ABSTRACT

An inductor includes a body including a support member, a coil, and an encapsulant encapsulating the support member and the coil and external electrodes disposed on an external surface of the body and connected to the coil, wherein the support member includes a through-hole and a via hole spaced apart from the through-hole, the coil includes a first coil disposed on one surface of the support member and a second coil disposed on the other surface of the support member opposing the one surface, the first and second coils are connected to each other by a via filling the via hole, and the via continuously covers an end surface of the first coil and an upper surface of the second coil.

20 Claims, 4 Drawing Sheets

(51) Int. Cl.
*H01F 41/12* (2006.01)
*H01F 41/04* (2006.01)

(56) References Cited

U.S. PATENT DOCUMENTS

| | | | | |
|---|---|---|---|---|
| 2015/0035634 | A1* | 2/2015 | Nakamura | H01F 41/046 336/170 |
| 2015/0270053 | A1* | 9/2015 | Cha | C25D 5/02 336/192 |
| 2016/0163444 | A1 | 6/2016 | Choi et al. | |
| 2016/0217907 | A1 | 7/2016 | Jeong | |
| 2017/0032882 | A1* | 2/2017 | Yang | H01F 41/042 |
| 2017/0032885 | A1 | 2/2017 | Lee et al. | |
| 2017/0045746 | A1 | 2/2017 | Ellsworth et al. | |
| 2018/0019051 | A1 | 1/2018 | Bong et al. | |
| 2018/0197672 | A1 | 7/2018 | Kim et al. | |

FOREIGN PATENT DOCUMENTS

| | | | |
|---|---|---|---|
| CN | 105448503 | A | 3/2016 |
| CN | 105826050 | A | 8/2016 |
| CN | 106409484 | A | 2/2017 |
| JP | H04-273496 | A | 9/1992 |
| JP | 2000-150241 | A | 5/2000 |
| JP | 2013-089876 | A | 5/2013 |
| KR | 10-1999-0066108 | A | 8/1999 |
| KR | 10-2007-0026048 | A | 3/2007 |
| KR | 10-2015-0071266 | A | 6/2015 |
| KR | 10-2017-0014957 | A | 2/2017 |
| KR | 10-2017-0090130 | A | 8/2017 |
| KR | 10-2017-0097883 | A | 8/2017 |
| KR | 10-2018-0007897 | A | 1/2018 |
| KR | 10-1862503 | B1 | 5/2018 |

OTHER PUBLICATIONS

Office Action issued in corresponding Korean Patent Application No. 10-2018-0064147 dated Jul. 10, 2019.

Chinese Office Action dated Jun. 30, 2021 issued in Chinese Patent Application No. 201910117839.6 (with English translation).

* cited by examiner

INDUCTOR

CROSS-REFERENCE TO RELATED APPLICATION

This application claims the benefit of priority to Korean Patent Application No. 10-2018-0064147 filed on Jun. 4, 2018 in the Korean Intellectual Property Office, the disclosure of which is incorporated herein by reference in its entirety.

TECHNICAL FIELD

The present disclosure relates to an inductor and, more particularly, to a thin film type power inductor.

BACKGROUND

Recently, as the central processing units (CPUs) for personal computers (PCs) and portable devices such as smartphones, tablet PCs, and the like, have been multifunctionalized, have been implemented with high performance, and have been reduced in size and weight, electronic devices used therein have also been required to be implemented with high performance, to be reduced in size, weight, and thickness, as well as to be multifunctionalized and highly integrated. Power inductors, which are largely used in DC-DC converters of power supply terminals of portable devices, are being developed to be more compact and thin on a continual basis.

SUMMARY

An aspect of the present disclosure may provide an inductor having a good level of saturation current (Isat) through a simple process.

According to an aspect of the present disclosure, an inductor may include: a body including a support member, a coil, and an encapsulant encapsulating the support member and the coil, and external electrodes disposed on an external surface of the body and connected to the coil, wherein the support member includes a through-hole and a via hole spaced apart from the through-hole, the coil includes a first coil disposed on one surface of the support member and a second coil disposed on the other surface of the support member opposing the one surface, the first and second coils are connected to each other by a via filling the via hole, and the via continuously covers an end surface of the first coil and an upper surface of the second coil.

Each of the first and second coils may include a plurality of conductive layers.

A first seed layer disposed on the bottom of the plurality of conductive layers of the first coil and a second seed layer disposed on the bottom of the plurality of conductive layers of the second coil may have a rectangular cross-sectional shape.

A lower portion of the first seed layer disposed on the bottom of the plurality of conductive layers of the first coil and a lower portion of the second seed layer disposed on the bottom of the plurality of conductive layers of the second coil may be increased in width toward the support member.

A side surface of the lower portion of each of the first and second seed layers may be curved.

A side surface of the first seed layer may be spaced apart from the via hole.

An upper surface of the second seed layer may be disposed to encapsulate the via hole on the same plane as the other surface of the support member.

The via may be directly connected to one end of the innermost coil pattern of the first coil.

The via may be directly connected to one end of the innermost coil pattern of the second coil.

A side surface of one end of the innermost coil pattern of the first coil and the via may be integrally formed without a boundary.

The first coil and the second coil may be disposed to deviate from each other with respect to a virtual central line of the via hole perpendicular to the support member.

A thickness of the support member may range from 10 μm to 20 μm.

The support member may be an insulating film.

The encapsulant may fill the through-hole.

At least a portion of an upper surface of the via is covered by an insulating layer.

The entire upper surface of the via may be covered by one end of the first coil.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Hereinafter, exemplary embodiments in the present disclosure will be described in detail with reference to the accompanying drawings.

Hereinafter, an inductor according to an example of the present disclosure will be described but the present disclosure is not limited thereto.

Figure 1:
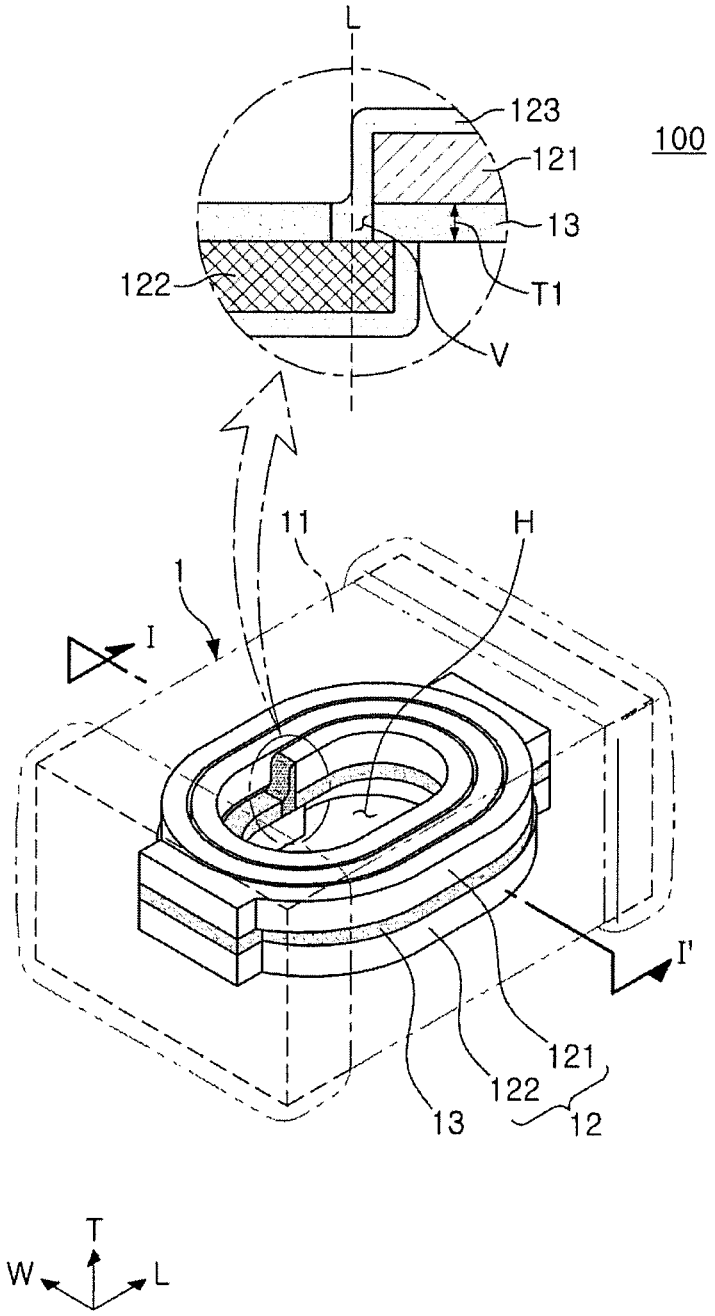
FIG. 1 is a schematic perspective view of an inductor according to an exemplary embodiment in the present disclosure.
Figure 2:
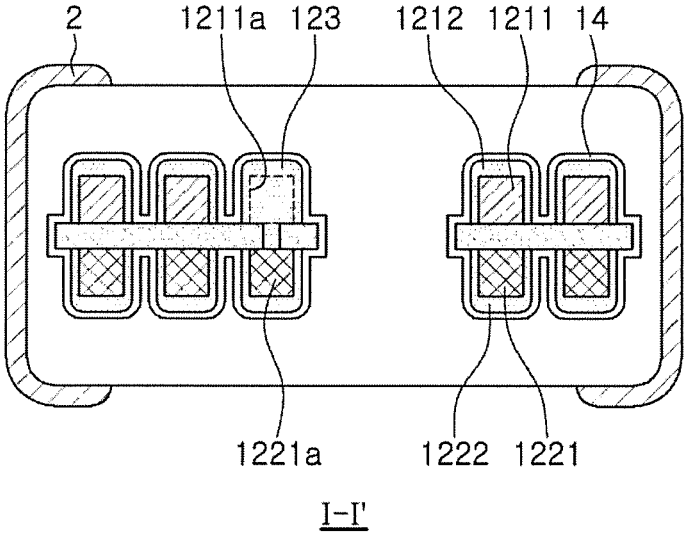
FIG. 2 is a cross-sectional view taken along line I-I' of FIG. 1.

FIG. 1 is a schematic perspective view of an inductor 100 according to an example of the present disclosure, and FIG. 2 is a cross-sectional view taken along line I-I' of FIG. 1.

Referring to FIGS. 1 and 2, the inductor 100 includes a body 1 and external electrodes 2 disposed on an external surface of the body 1.

Since the external electrodes 2 are connected to the ends of a coil in the body 1, the external electrodes 2 are formed of a material having excellent conductivity. The external electrodes may have a multilayer structure including a conductive resin layer, and an outermost part thereof may be sequentially plated with a Ni plating layer and a Sn plating layer. A shape of the external electrodes may be appropriately designed and changed by those skilled in the art, as necessary. The external electrodes may have a C shape as illustrated in FIG. 1 or may be bottom electrodes or L-shaped electrodes.

The body 1 has an upper surface and a lower surface opposing each other in the thickness direction T, a first end surface and a second end surface opposing each other in the length direction L, and a first side surface and a second side surface opposing each other in the width direction W, having a hexagonal shape. The body 1 includes an encapsulant 11, and a shape of the body is substantially defined by the encapsulant 11 and an insulating material (not shown) covering the encapsulant 11.

The encapsulant 11 of the body 1 may be formed of a material having magnetic properties without limitation and may include a composite material of a magnetic material and a resin. For example, the magnetic material may include metal particles of ferrite or iron (Fe), chromium (Cr), aluminum (Al) or nickel (Ni), or may also include silicon (Si), boric acid (B), niobium (Nb), or the like. The resin may be an epoxy resin. The composite material may have a structure in which the magnetic material is dispersed in an epoxy resin.

A coil 12 and a support member 13 supporting the coil 12 are sealed (or encapsulated) by the encapsulant 11.

The support member 13 includes a through-hole H at the center and a via hole V spaced apart from the through-hole H. The inside of the through-hole H may be filled with the encapsulant to facilitate flow of a magnetic field of the coil and improve magnetic permeability of the inductor. Also, the via hole V may be filled with a conductive material to connect the first coil 121 and the second coil 122 respectively disposed on one surface and the other surface of the support member 13.

Since the support member 13 serves to support the coil, the support member 13 must have appropriate mechanical rigidity, but a thickness T1 thereof may need to be reduced. The thickness T1 is preferably 60 μm or less, and more preferably 10 μm or more and 30 μm or less to make the support member 13 thin. If a support member is thinner than 10 μm, it may be difficult to realize sufficient rigidity to support the coil. If a support member is thicker than 30 μm, the thickness of the encapsulant to fill upper and lower portions of the coil may be relatively reduced to degrade Isat.

The support member 13 may be an insulating film. For example, a known Ajimoto build-up (ABF) film, or the like, may be used but the present disclosure is not limited thereto.

A first coil 121 is disposed on one surface of the support member 13 and a second coil 122 is disposed on the other surface of the support member 13 opposing the one surface.

The first and second coils 121 and 122 may be wound around in a direction to have a spiral shape.

The first and second coils 121 and 122 are disposed to deviate from each other with respect to a virtual central line L in the via hole V perpendicular to the support member 13. In the related art, the first and second coils overlap each other on the basis of a virtual central line in the via hole V, as the center. In contrast, in the present disclosure, referring to FIG. 1, the first coil 121 is disposed to be inclined to the right-hand side in the length direction with respect to the virtual central line L, while the second coil 122 is disposed in both sides of the virtual central line L.

The first and second coils 121 and 122 include a plurality of conductive layers.

A conductive layer disposed at the bottom and positioned to be in direct contact with the support member 13, among a plurality of conductive layers of the first coil 121, is a first seed layer 1211 and a conductive layer disposed on the first seed layer is a first plating layer 1212. Similarly, a conductive layer disposed at the bottom and positioned to be in direct contact with the support member 13, among a plurality of conductive layers of the second coil 122, is a second seed layer 1221 and a conductive layer disposed on the second seed layer 1221 is a second plating layer 1222.

A method of forming the first and second seed layers is not limited. However, in the case of the present disclosure, a method of forming base plating layers, each having a predetermined thickness (equal to the thicknesses of the first and second seed layers) on one surface and the other surface of the support member 13 and subsequently patterning the base plating layers, is advantageous. The method of patterning the base plating layer may be a subtractive method, and this method may be easily applied because the thicknesses of the base plating layers, i.e., the thicknesses of the first and second seed layers, are not thick.

Figure 4:
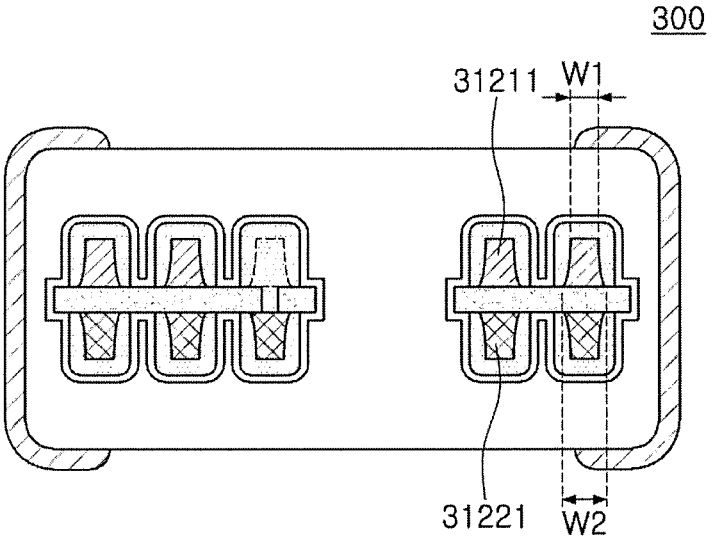
FIG. 4 is a cross-sectional view according to another modification of FIG. 2.

Since the first and second seed layers are formed by patterning the base plating layers using the substractive method, a cross-section of the first and second seed layers may have a rectangular shape as illustrated in FIG. 2. Meanwhile, FIG. 4 is a cross-sectional view of an inductor 300 according to a modification of FIG. 2. The inductor 300 illustrated in FIG. 4 is formed such that a line width w2 of lower portions of the first and second seed layers is larger than a line width w1 of upper portions in the cross-sectional shapes of the first and second seed layers and the side surfaces are curved. The cross-sectional shapes of the first and second seed layers 31211 and 31221 of the inductor 300 of FIG. 4 may be realized by etching the base plating layers using a tenting method when the first and second seed layers are patterned. Since the line width of a contact area between the support member and the first and second seed layers 31211 and 31221 is relatively larger than the line width of the upper surfaces of the seed layers, the first and second coils may be stably attached to the support member.

Referring back to FIG. 1, the first and second coils 121 and 122 are connected by a via 123. The via 123 may be defined as a conductive material filling the via hole V. The via 123 is configured to continuously cover an end surface of the first coil 121 and a portion of a lower surface of the second coil 122. The via 123 is formed at the same time during a process of forming the first and second plating layers 1212 and 1222 on the first and second seed layers 1211 and 1221, rather than through a separate process therefor. As a result, the first plating layer 1212 covering a portion of the first seed layer 1211*a* forming the end of the first coil 121 is replaced with the via 123. As a result, the end surface of the first coil 121 covered by the via 123 is an end surface of the first seed layer 1211*a*, and the lower surface of the second coil 122 in contact with the via 123 is a lower surface of the second seed layer 1221*a* forming the end of the second coil 122.

The surfaces of the first and second coils 121 and 122 are coated with the insulating layer 14. As a method of forming the insulating layer 14, those skilled in the art may appropriately select insulated coating, stacking an insulating sheet, chemical vapor deposition (CVD), or the like. When the insulating layer 14 is formed on the first and second coils 121 and 122, the insulating layer 14 is also formed on a surface of the via 123 since a portion of the via 123 covers the end surface of the first coil 121. As a material of the insulating layer 14, a material having excellent processiblity and insulating properties may be used. For example, a resin such as an epoxy, polyimide, perylene, and the like, may be applied.

Figure 3:
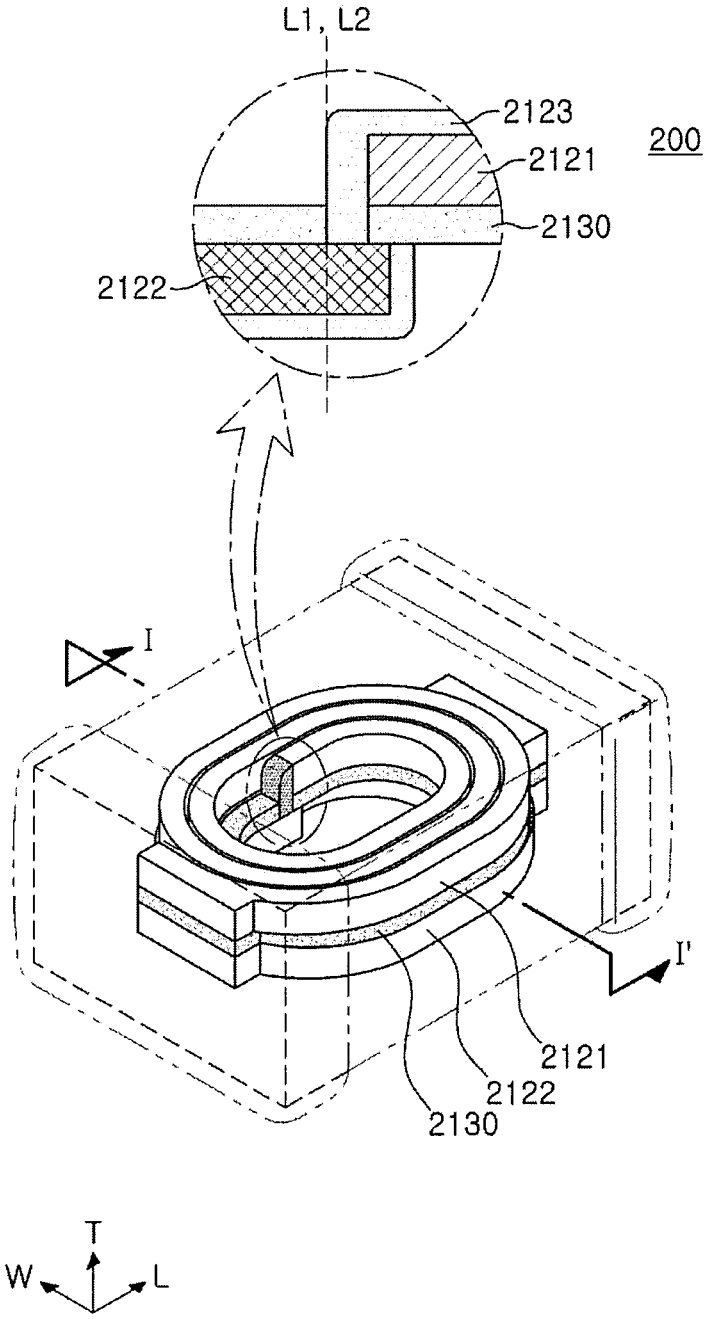
FIG. 3 is a cross-sectional view according to a modification of FIG. 2.

FIG. 3 is a cross-sectional view of an inductor 200 according to a modification of the inductor 100 of FIG. 1. The inductor 200 of FIG. 3 is different from the inductor 100 of FIG. 1 only in the size of the via and includes substantially the same components. For purposes of description, a redundant description thereof will be omitted.

In FIG. 3, a line width of a via 2123 of the inductor 200 is larger than the via 123 of the inductor 100 described above. Referring to FIG. 3, one side surface L1 of the via 2123 is disposed to be coplanar with one side surface L2 of a via hole adjacent thereto. Also, although not specifically shown, those skilled in the art may extend the one side surface L1 to an outer side of the one side surface L2 as necessary. The via 2123 may become thicker by controlling a concentration of a plating solution, a plating rate, a plating time, and the like.

By increasing the line width of the via 2123, connection of the via 2123 with the first and second coils 2121 and 2122 may be strengthened.

Although not specifically shown, those skilled in the art may increase the line width and/or thickness of the first and second plating layers covering the first and second seed layers, while increasing the line width of the via 2123. Since the via is formed simultaneously when the first and second plating layers are formed, the sizes of the via and the first and second plating layers may be appropriately controlled by controlling a plating time, a concentration of a plating solution, and the like, applied by those skilled in the art.

In the case of the inductor described above, a separate plating process for forming the seed layer may be omitted by utilizing the known copper clad laminate (CCL) substrate or by utilizing a substrate including base plating layers on opposing surfaces of the thin support member. Specifically, demand for the provision of a low-priced inductor having a low aspect ratio, not requiring a high aspect ratio, may be met by utilizing a copper layer on a previously prepared CCL substrate or the base plating layer as a seed layer.

As set forth above, according to exemplary embodiments of the present disclosure, the inductor in which a filling rate of a magnetic material of the coil is increased and the thickness of the support member is reduced, while process cost and time are reduced, may be provided.

While exemplary embodiments have been shown and described above, it will be apparent to those skilled in the art that modifications and variations could be made without departing from the scope of the present disclosure as defined by the appended claims.

What is claimed is:

1. An inductor comprising:

a body including a support member, a coil, and an encapsulant encapsulating the support member and the coil; and external electrodes disposed on an external surface of the body and electrically connected to the coil, wherein the support member includes a through-hole and a via hole spaced apart from the through-hole, the coil includes a first coil disposed on a first surface of the support member and a second coil disposed on a second surface of the support member opposing the first surface, the first and second coils are connected to each other by a via filling the via hole, the via continuously covers an end surface of the first coil and a portion of a lower surface of the second coil, and the end surface of the first coil and an inner surface of the via hole are substantially coplanar with each other.

2. The inductor of claim 1, wherein the via is directly connected to one end of an innermost coil pattern of the first coil.

3. The inductor of claim 1, wherein the via is directly connected to one end of an innermost coil pattern of the second coil.

4. The inductor of claim 1, wherein a first conductive layer disposed on the first seed layer formed at one end of the first coil is integrally formed with the via.

5. The inductor of claim 1, wherein the first coil and the second coil are disposed to deviate from each other in a length direction of the support member with respect to a virtual central line of the via hole perpendicular to the support member.

6. The inductor of claim 1, wherein a thickness of the support member ranges from 10 μm to 30 μm.

7. The inductor of claim 1, wherein the support member is an insulating film.

8. The inductor of claim 1, wherein the encapsulant fills the through-hole.

9. The inductor of claim 1, wherein a line width of the via hole in a length direction of the support member is larger than a line width of a portion of the via that covers the end surface of the first coil.

10. The inductor of claim 1, wherein a line width of the via hole in a length direction of the support member is substantially equal to a line width of a portion of the via that covers the end surface of the first coil, and one side surface of the portion of the via that covers the end surface of the first coil is coplanar with one side surface of the via hole adjacent thereto.

11. The inductor of claim 1, wherein each of the first and second coils includes a plurality of conductive layers.

12. The inductor of claim 11, wherein a first seed layer is a bottommost layer among the plurality of conductive layers of the first coil, and a second seed layer is a bottommost layer among the plurality of conductive layers of the second coil, the first and second seed layers each having a rectangular cross-sectional shape.

13. The inductor of claim 12, wherein a width of a lower portion of each of the first and second seed layers increases in a stacking direction of the first and second coils toward the support member.

14. The inductor of claim 13, wherein a side surface of the lower portion of each of the first and second seed layers is curved.

15. The inductor of claim 12, wherein a side surface of the first seed layer is spaced apart from the via hole.

16. The inductor of claim 12, wherein a lower surface of the second seed layer is disposed to encapsulate the via hole on the same plane as the second surface of the support member.

17. The inductor of claim 1, wherein the first and second coils are coated with an insulating layer.

18. The inductor of claim 17, wherein a surface of the via is covered by the insulating layer.

19. The inductor of claim 1, wherein one side surface of the via extends to an outer side, relative to one side surface of the via hole.

20. An inductor comprising:

a body including a support member, a coil, and an encapsulant encapsulating the support member and the coil; and external electrodes disposed on an external surface of the body and electrically connected to the coil, wherein the support member includes a through-hole and a via hole spaced apart from the through-hole, the coil includes a first coil disposed on a first surface of the support member and a second coil disposed on a second surface of the support member opposing the first surface, the first and second coils are connected to each other by a via filling the via hole, the via is integrally formed with a plating layer of the first coil, the plating layer being an uppermost layer of the first coil, and the via is spaced apart from an end surface of the second coil.

* * * * *